US005974608A

United States Patent [19]

Haller et al.

[11] Patent Number: 5,974,608

[45] Date of Patent: Nov. 2, 1999

[54] CAMPING MATTRESS WITH CRADLING CUSHIONS

[75] Inventors: Clayton Forbes Haller, Pleasant Hill; Charles Prior Hall, Santa Rosa, both of Calif.

[73] Assignee: Stearns, Inc., St. Cloud, Minn.

[21] Appl. No.: 09/089,293

[22] Filed: Jun. 1, 1998

[51] Int. Cl.[6] ..... A47C 27/18; A47C 27/14

[52] U.S. Cl. ..... 5/709; 5/420; 5/732

[58] Field of Search ..... 5/420, 732, 709, 5/710, 711, 632, 706, 655.3

[56] References Cited

U.S. PATENT DOCUMENTS

| | | | |
|---|---|---|---|
| 1,576,211 | 3/1926 | O' kane | 5/732 |
| 2,549,597 | 4/1951 | Harris et al. | 5/732 |
| 4,428,087 | 1/1984 | Morn | 5/709 |
| 4,688,283 | 8/1987 | Jacobson et al. | 5/709 |
| 5,303,435 | 4/1994 | Maar et al. | 5/709 |
| 5,604,945 | 2/1997 | Fisher et al. | 5/710 |
| 5,634,224 | 6/1997 | Gates | 5/709 |
| 5,754,998 | 5/1998 | Selton | 5/732 |

FOREIGN PATENT DOCUMENTS

| | | | |
|---|---|---|---|
| 494496 | 7/1950 | Belgium | 5/709 |
| 918227 | 7/1949 | Germany | 5/706 |
| 2163951 | 3/1986 | United Kingdom | 5/732 |

*Primary Examiner*—Alexander Grosz
*Attorney, Agent, or Firm*—Flehr Hohbach Test Albritton & Herbert LLP

[57] ABSTRACT

Self-inflating mattress for outdoor and camping use having a body chamber which contains open cell foam for supporting the body and legs of a person resting thereon, and air chambers positioned to the sides of the body chamber for cradling the person and preventing him from rolling off the mattress. The body chamber is reduced in width in the lower back region, and the air chambers extend into that region to provide additional lower back support.

22 Claims, 4 Drawing Sheets

CAMPING MATTRESS WITH CRADLING CUSHIONS

This invention pertains generally to mattresses and, more particularly, to a mattress which is particularly suitable for outdoor use such as camping.

Mattresses heretofore provided for camping and other outdoor use have been of three main types: inflatable air mattresses, relatively thin foam pads, and self-inflating mattresses with open cell foam pads. Each of these mattresses has certain advantages such as being relatively lightweight and capable of being rolled up for backpacking and stowage. Each also has certain disadvantages such as being relatively limited in size and easy to roll off of.

U.S. Pat. No. 5,303,435 discloses a self-inflating camping mattress having a tapered profile and an air-filled pillow at one end, which is particularly suitable for use in tapered sleeping bags.

It is in general an object of the invention to provide a new and improved mattress which is particularly suitable for camping and other outdoor use.

Another object of the invention is to provide a mattress of the above character which overcomes the limitations and disadvantages of the prior art.

These and other objects are achieved in accordance with the invention by providing a mattress having a body chamber which contains open cell foam for supporting the body and legs of a person resting thereon, and air chambers positioned to the sides of the body chamber for cradling the person and preventing him from rolling off the mattress. The body chamber is reduced in width in the lower back region, and the air chambers extend into that region to provide additional lower back support.

Figure 1:
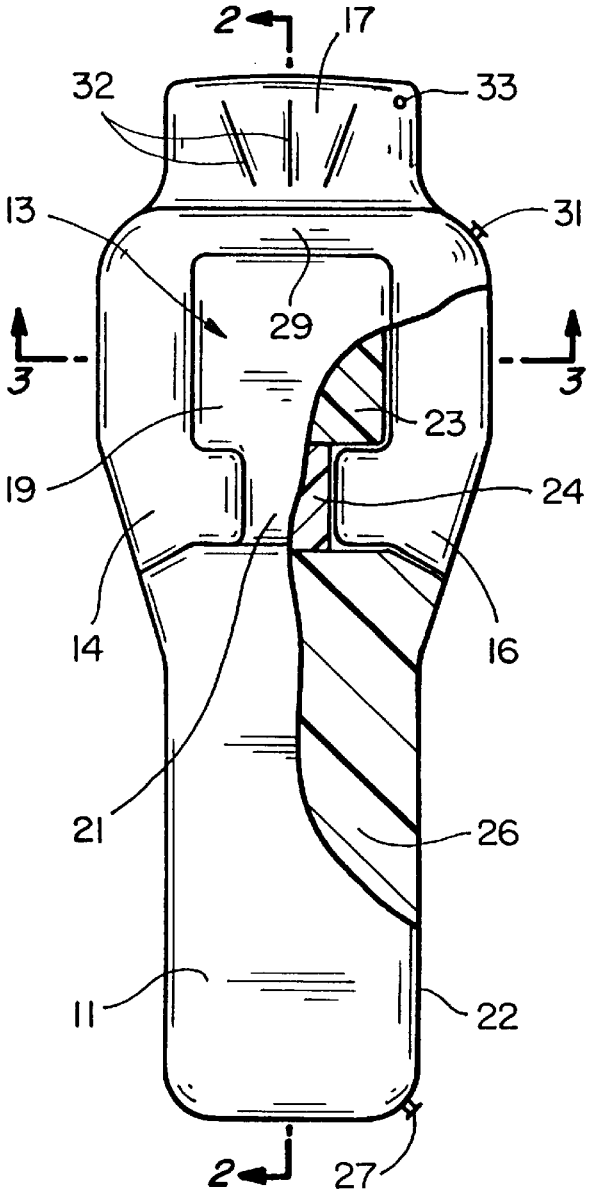
FIG. 1 is top plan view, partly broken away, of one embodiment of a mattress incorporating the invention.
Figure 2:
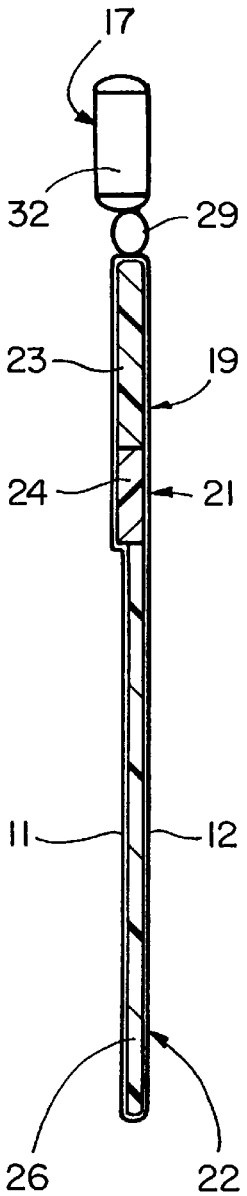
FIG. 2 is a cross-sectional view taken along line 2—2 of FIG. 1.
Figure 3:
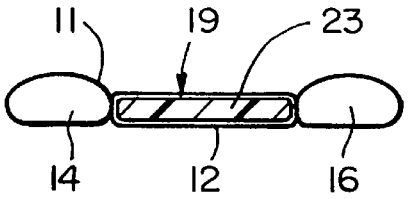
FIG. 3 is a cross-sectional view taken along line 3—3 of FIG. 1.

As illustrated in FIGS. 1—3, the mattress includes a pair of superposed sheets 11, 12 which are sealed together to form a body chamber 13, air chambers 14, 16, and a pillow chamber 17.

The sheets are fabricated of an air-impervious flexible material such as nylon, polyvinyichloride (PVC), urethane or rayon. When woven materials such as nylon and rayon are used, they can be coated with a material such as vinyl to make them impervious. If desired, the two sheets can be fabricated of different materials to give them different properties. In this regard, the upper sheet might, for example, be made of a softer material such as a rayon blend, and the bottom sheet might be made of more durable material to resist punctures.

Body chamber 13 extends substantially the entire length of the mattress, from pillow chamber 17 to the foot of the mattress. It is divided into three sections for receiving different portions of the body of a person resting on the mattress. These sections include an upper back section 19, a lower back section 21, and a leg section 22.

Open cell foam pads 23, 24 and 26 are disposed in the three sections of the body chamber, and a valve 27 controls the flow of air into and out of the chamber. The three pads form a self-inflating mattress which can be expanded for use and compressed for transportation and stowage. The pads are expanded by opening the valve and allowing air to enter the chamber, and they are compressed by rolling the mattress up to expel the air through the valve, then closing the valve so that the differential in air pressure outside and inside the chamber maintains the pads in the compressed state.

Pads 23 and 24 support the upper and lower back portions of a person resting on the mattress, and pad 26 supports his legs. Since the legs do not require as much support as the upper body, pad 26 can be made thinner than the others. In one presently preferred embodiment, pads 23 and 24 have a thickness on the order of 2 to 2½ inches, and pad 26 has a thickness on the order of 1 inch in the expanded state. Alternatively, pad 26 can be tapered in thickness and so that it is thinner toward the foot of the mattress. It might, for example, have a thickness on the order of 2 to 2½ inches toward pad 24 and a thickness of 1 inch at the foot.

Air chambers 14, 16 extend along the sides of the upper and lower back sections of the body chamber, and provide a cradling effect which prevents a person from rolling off the mattress. In addition, since the air tends to provide a firmer support than the foam, the two air chambers project inwardly toward the middle section of the body chamber to provide additional support for the lower back of a person resting on the mattress. The two air chambers communicate with each other through a cross channel or chamber 29 which extends across the mattress between the base of pillow chamber 17 and the head end of body chamber 13. Air flow into and out of the air chambers is controlled by a valve 31.

A plurality of I-beams or baffles 32 extend between the upper and lower sheets in the pillow chamber to hold the sheets together and prevent bowing or doming so that the pillow will have a relatively flat contour and provide a more stable head rest. The pillow has a thickness or height on the order of 4–5 inches, approximately twice the thickness of the foam pads. Air flow into and out of the pillow chamber is controlled by a valve 33.

In the embodiment illustrated, the mattress has a tapered profile which makes it particularly suitable for use with tapered sleeping bags which are commonly known as "mummy" bags. In this embodiment, it has an overall length on the order of 6 feet and a width on the order of 28 inches in the upper body area. Pillow chamber 17 is approximately 18 inches wide, 10 inches long, and 4–5 inches thick, and body chamber 13 has a length of approximately 62 inches. Foam pad 23 has a length and a width on the order of 14 inches each, pad 24 has a length on the order of 7 inches and a width on the order of 6 inches, and pad 26 has a length on the order of 41 inches and a width throughout most of its length on the order of 18 inches. In this embodiment, air chambers 14, 16 each project inwardly for approximately 4 inches past the lateral edges of upper back pad 23 to provide additional support for the lower back, and they extend about an inch or two above the foam pads to provide a cradling effect.

In use, air chambers 14, 16 and pillow chamber 17 are inflated by blowing air into them through valves 31, 33, and valve 27 is opened to allow air to flow into body chamber 13 to expand foam pads 23, 24 and 26. The body and legs of a person resting on the mattress are supported primarily by the foam pads, and his head is supported by the pillow. As noted above, air chambers provide a cradling effect which prevents the person from rolling off the mattress, and they also provide additional support for the lower back.

The mattress is deflated by opening all of the valves, squeezing the air out of the pillow chamber and the air chambers, then rolling the mattress up from head to food to compress the foam and expel the air from the body chamber. Once the mattress is rolled up, valve 27 is closed to maintain the foam in the compressed state. If desired, the mattress can be folded along its longitudinal center line prior to rolling to reduce the width of the rolled up mattress and make it more compact and easier to fit in certain backpacks.

Figure 4:
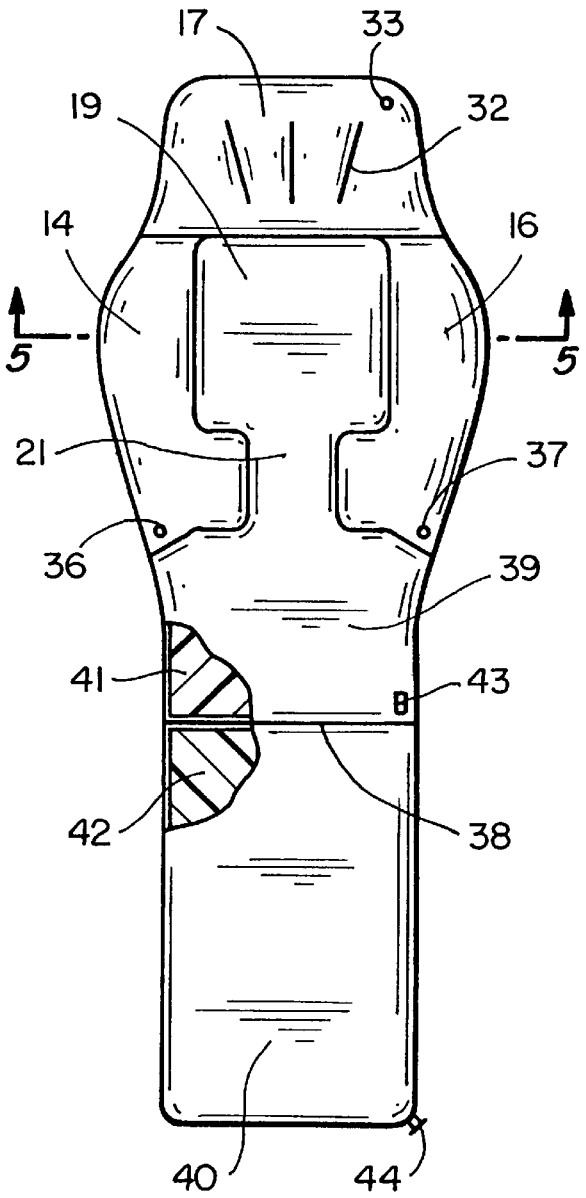
FIG. 4 is a top plan view, partly broken away, of another embodiment of a mattress according to the invention.
Figure 5:
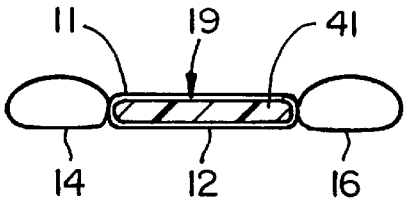
FIG. 5 is a cross-sectional view taken along line 5—5 of FIG. 4.

The embodiment of FIGS. 4–5 is generally similar to the embodiment of FIGS. 1–3, and like reference numerals designate corresponding elements in the two embodiments. In the embodiment of FIGS. 4–5, however, air chambers 14, 16 are independent of each other, with no cross channel or other communication between them, and separate air valves 36, 37 are provided for the respective chambers.

Also, in the embodiment of FIGS. 4–5, body chamber 13 is separated into two isolated sections by a seal line 38 which extends across the upper portion of leg section 22 and divides it into an upper leg section 39 and a lower leg section 40. A single foam pad 41 is disposed in upper back section 19, lower back section 21 and upper leg section 39, and a second foam pad 42 is disposed in lower leg section 40. Each of these pads has a thickness on the order of 1½ inches, and separate air control valves 43, 44 are provided for the two sections.

Operation and use of the embodiment of FIGS. 4–5 is similar to that described above, except the two air chambers are inflated and deflated separately, as are the two chambers containing the foam pads. Having the lower leg section isolated from the rest of the body chamber prevents the upper body from bottoming out (ie., contacting the ground) due to air rushing out of that section into the lower leg area where pressure is lower.

Figure 6:
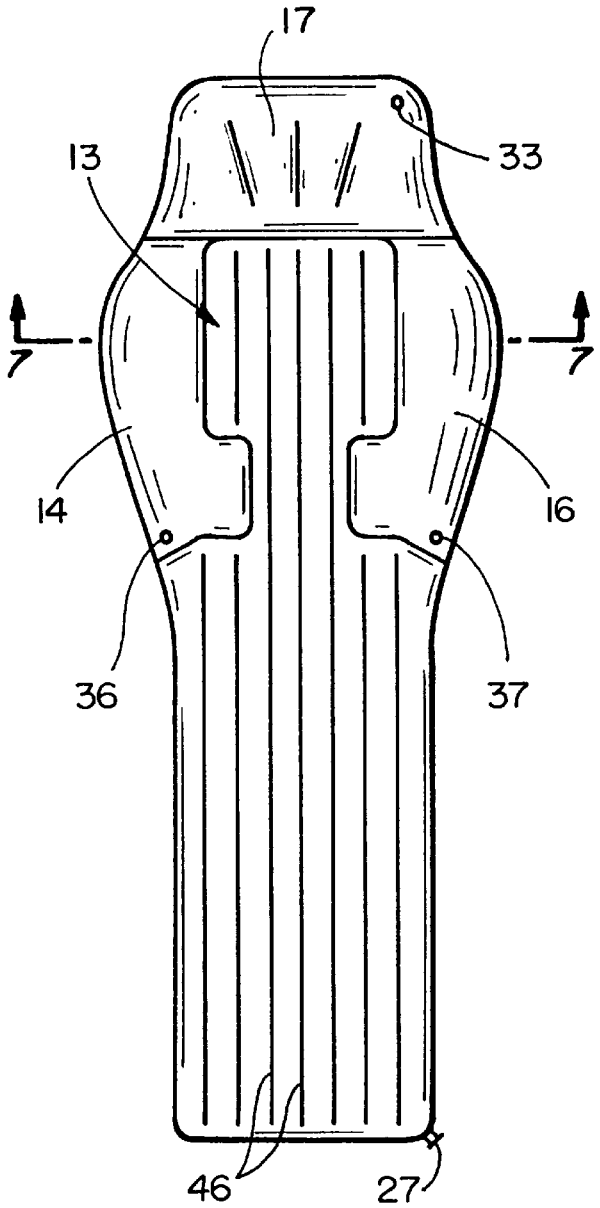
FIG. 6 is a top plan view of another embodiment of a mattress according to the invention.
Figure 7:
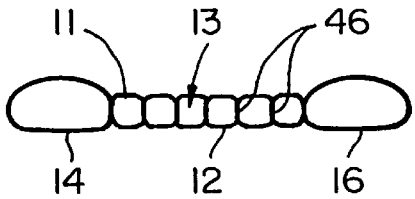
FIG. 7 is a cross-sectional view taken along line 7—7 of FIG. 6.

The embodiment of FIGS. 6–7 is similar to the others except that body chamber 13 is inflated with air, rather than having foam pads. A plurality of I-beams or baffles 46 are spaced about 2¼ inches apart and extend lengthwise of the chamber to provide a relatively flat sleeping surface. As in the other embodiments, when the air chambers at the sides of the mattress are inflated, they provide a cradling effect. This embodiment has an additional advantage in that is very light in weight and, therefore, even easier to carry than the embodiments with foam. It is also economical to manufacture.

Figure 8:
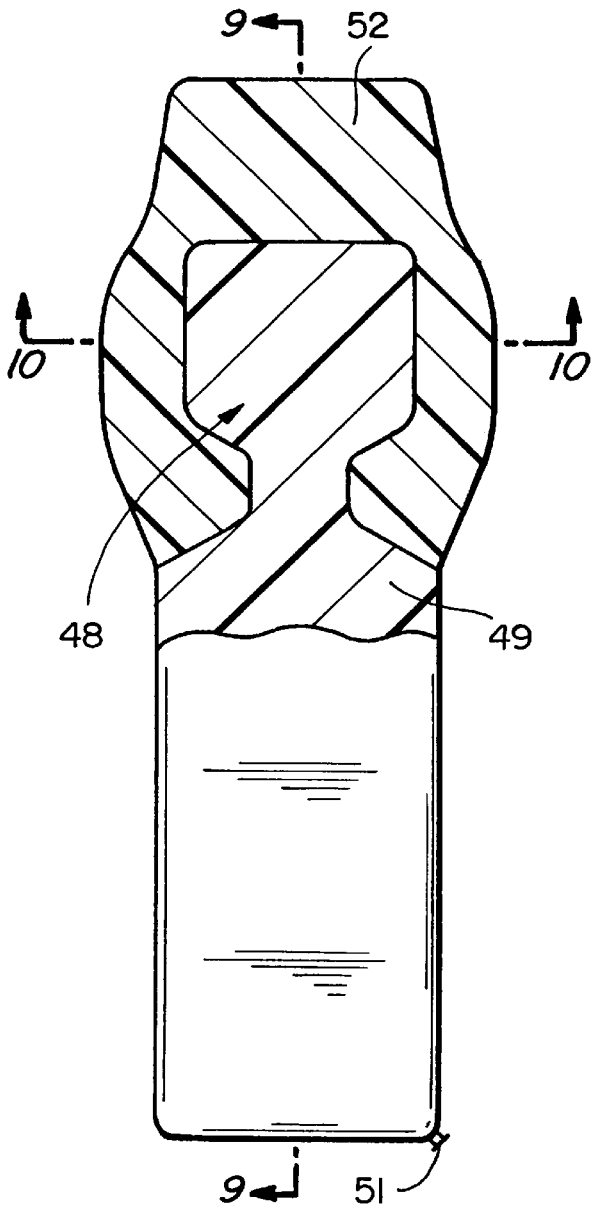
FIG. 8 is top plan view, partly broken away, of another embodiment of a mattress according to the invention.
Figure 9:
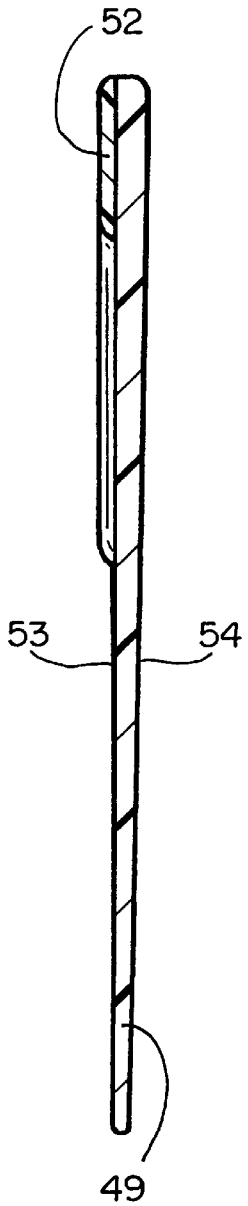
FIG. 9 is a cross-sectional view taken along line 9—9 of FIG. 8.
Figure 10:
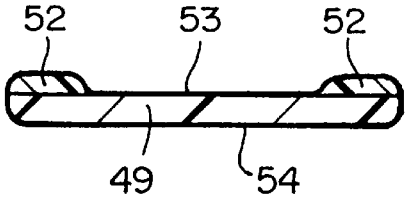
FIG. 10 is a cross-sectional view taken along line 10—10 of FIG. 8.

The embodiment of FIGS. 8–10 is also similar to the others except that the cradling effect is provided by foam, rather than by air chambers. In this embodiment, the mattress has a single chamber 48 for the pillow, upper and lower body, and leg sections, as well as the cradling cushions, and a foam pad 49 extends throughout the entire chamber. Air flow to and from the chamber is controlled by a valve 51 at the foot of the mattress.

Pad 49 is constructed of open cell foam, and it tapers in thickness from about 2½ inches at the head to about 1 inch at the foot.

An additional layer 52 of foam is provided on top of the base layer or pad 49 at the head of the mattress and along the sides where the air chambers are located in the other embodiments. It has a thickness on the order of 1 inch, and serves both as a raised pillow and as cradling cushions which prevent a person from rolling off the mattress. It is affixed to the base layer or pad by glue or other suitable means.

In this embodiment, the two sheets 53, 54 which enclose the foam are fabricated of a polyester material which is coated with polyurethane. After the two layers of foam are assembled together, the sheets are permanently bonded to the foam by heat bonding. The mattress then has a 3-dimensional contoured look, and provides the cradling effect.

The invention has a number of important features and advantages. The combination of the self-inflating foam and the air chambers provides a comfortable sleeping surface, and the side cushions provide additional support for the lower back as well as cradling the sleeper to prevent him from rolling off the mattress. With the air chambers, less foam is required, and this reduces both the cost and the weight of the mattress. In addition, the mattress can be folded and rolled into a compact package for backpacking and stowage.

It is apparent from the foregoing that a new and improved mattress has been provided. While only certain presently preferred embodiments have been described in detail, as will be apparent to those familiar with the art, certain changes and modifications can be made without departing from the scope of the invention as defined by the following claims.

We claim:

1. In a mattress: a body chamber having back and leg sections for supporting the body and legs of a person resting thereon, and cradling cushions extending along the sides of the back section but not the leg section for cradling the person and preventing him from rolling off the mattress.

2. The mattress of claim 1 wherein the body chamber contains open cell foam for supporting the body and legs of the person.

3. The mattress of claim 1 wherein the body chamber is filled with air.

4. The mattress of claim 1 wherein the cradling cushions are air-filled chambers.

5. The mattress of claim 1 wherein the cradling cushions are fabricated of foam.

6. In a mattress: a body chamber containing open cell foam for supporting the body and legs of a person resting thereon, and air chambers which are positioned to the sides of the body chamber and are substantially thicker than the body chamber for cradling the person and preventing him from rolling off the mattress.

7. The mattress of claim 6 wherein the body chamber is divided into an upper body section and a leg section which are separated from each other with no communication between the two sections.

8. The mattress of claim 7 further including a pillow chamber toward the head of the mattress.

9. The mattress of claim 6 wherein the body chamber has upper back, lower back, and leg sections, and the foam in at least a portion of the leg section is thinner than the foam in the upper back section and the lower back section.

10. The mattress of claim 9 wherein the foam in the leg section is tapered in thickness and is thinner toward the foot of the mattress.

11. In a mattress: a body chamber having upper back, lower back, and leg sections containing open cell foam for supporting the body and legs of a person resting thereon, and air chambers extending along the sides of the upper and lower back sections, but not the leg section, for cradling the person and preventing him from rolling off the mattress.

12. In a mattress: a body chamber having upper back lower back, and leg sections containing open cell foam for supporting the body and legs of a person resting thereon, and air chambers positioned to the sides of the body chamber for cradling the person and preventing him from rolling off the mattress, the lower back section being narrower than the other sections, and the air chambers projecting inwardly toward the lower back section to provide additional lower back support for the person resting on the mattress.

13. In a mattress: two superposed sheets of flexible material joined together to form a body chamber, air chambers on opposite sides of the body chamber, and a pillow chamber at one end of the body chamber; and open cell foam in the body chamber for supporting the body and legs of a person resting on the mattress.

14. The mattress of claim 13 including an I-beam extending between the two sheets of flexible material in the pillow chamber to prevent the sheets from separating by more than a predetermined distance.

15. The mattress of claim 13 wherein the foam is thinner toward the end of the body chamber opposite the pillow chamber.

16. In a mattress: two superposed sheets of flexible material joined together to form a body chamber, air chambers on opposite sides of the body chamber, a pillow chamber at one end of the body chamber, and a channel positioned between the body chamber and the pillow chamber to provide communication between the air chambers; and open cell foam in the body chamber for supporting the body and legs of a person resting on the mattress.

17. In a mattress: two superposed sheets of flexible material joined together to form a body chamber, air chambers on opposite sides of the body chamber, a pillow chamber at one end of the body chamber, and open cell foam in the body chamber for supporting the body and legs of a person resting on the mattress, the body chamber having an upper back section, a lower back section, and a leg section, the lower back section being narrower than the upper back section and the leg section, and the air chambers projecting inwardly toward the lower back section to provide additional lower back support for the person resting on the mattress.

18. In a mattress: a body chamber having upper back, lower back and leg sections, with the lower back section being narrower than the other sections, foam in the body chamber for supporting the body and legs of a person resting on the mattress, and air chambers positioned to the sides of the upper back and lower back sections of the body chamber and projecting inwardly toward the lower back section.

19. The mattress of claim 18 wherein the air chambers are in communication with each other.

20. The mattress of claim 18 wherein the foam in at least a portion of the leg section is thinner than the foam in the upper back section and the lower back section.

21. The mattress of claim 18 wherein the foam in the leg section is tapered in thickness and is thinner toward the foot of the mattress.

22. The mattress of claim 18 further including a pillow chamber toward the head of the mattress.

* * * * *